United States Patent [19]

Giolitti

[11] 4,239,400

[45] Dec. 16, 1980

[54] ELECTRONICALLY CONTROLLED PRINTING UNIT

[75] Inventor: Alberto Giolitti, Ivrea, Italy

[73] Assignee: Ing. C. Olivetti & C., S.p.A., Turin, Italy

[21] Appl. No.: 920,076

[22] Filed: Jun. 28, 1978

[30] Foreign Application Priority Data

Jul. 29, 1977 [IT] Italy ..... 68772 A/77

[51] Int. Cl.[3] ..... B41J 1/30

[52] U.S. Cl. ..... 400/144.2; 400/184

[58] Field of Search ..... 101/93.19; 400/144–144.4, 156.1, 163.3, 164, 164.2, 184

[56] References Cited

U.S. PATENT DOCUMENTS

| | | | |
|---|---|---|---|
| 1,456,503 | 5/1923 | Heising | 400/156.1 X |
| 2,161,840 | 6/1939 | Adams | 400/144.2 X |
| 2,945,576 | 7/1960 | Lapointe et al. | 400/156.1 |
| 3,175,671 | 3/1965 | Lapointe et al. | 400/156.1 |
| 3,295,652 | 1/1967 | Sasaki | 400/164.2 X |
| 3,876,053 | 4/1975 | Giolitti et al. | 400/156.1 X |

*Primary Examiner*—Paul T. Sewell

*Attorney, Agent, or Firm*—Schuyler, Banner, Birch, McKie & Beckett

[57] ABSTRACT

The printing unit includes a daisy wheel typecarrier tranversely movable with respect to the paper. The various operations and printing functions are actuated by electronic means controlled by a mechanical memory, which through an electromechanic transducer causes a set of electronic controls to selectively control a set of linkages.

27 Claims, 8 Drawing Figures

ELECTRONICALLY CONTROLLED PRINTING UNIT

BACKGROUND OF THE INVENTION

The present invention relates to an electrically controlled printing unit, adapted particularly, but not exclusively, to be used in a typewriter.

A printing unit is known comprising a control circuit of electronic type, a fixed support guide and a printing assembly movable along the guide. The printing assembly generally comprises a type or character bearing element, a printing ribbon preferably contained in a corresponding cartridge, and a plurality of mechanical or electromechanical actuators controlled by the control circuit and adapted to allow the printing assembly to perform a plurality of functions. The functions may be, for example, the selection of a character, return of the printing assembly by one step, programming, normally indicated by the term "tabulation" of movements of the printing assembly by several steps forward or backward along the guide, etc. while service functions may be, for example, the striking of a character, advance of the printing assembly by one step after each striking action, feed of the printing ribbon, raising of the corresponding cartridge, etc.

In the above described known printing unit, the number of the actuators is generally proportional to the number of functions that the printing assembly is capable of performing, since each of the functions requires, for its own performance, the use of at least one actuator, which may be constituted by an electromagnet, a directcurrent motor or a stepping motor. Each of the actuators is controlled by a corresponding control assembly forming part of the control circuit and which, in the event of the actuator being a directcurrent motor, is an analogue control assembly.

The relatively high number of actuating means and of the corresponding control assemblies employed in the known printing unit generally entails some difficulties of carrying into effect and assembly, considerable overall dimensions and weights and, above all, a relatively high cost of production.

The object of the present invention is to provide a printing unit capable of performing functions like those of the abovedescribed known printing unit, but which is without the economic and structural disadvantages presented by the latter and hereinbefore mentioned.

SUMMARY OF THE INVENTION

According to the present invention there is provided a printing unit, comprising a fixed guide, a printing assembly movable along the guide and comprising a type bearing element, a printing ribbon, and actuating means adapted to actuate the type bearing element and the ribbon and to shift the printing assembly along said guide to cause the printing assembly to perform a given number of functions and electronic control means for the actuating means, wherein the actuating means comprise a motor, a mechanical store, at least one electromechanical transducer, acting as an interface between the electronic control means and the mechanical store, and a plurality of kinematic chains for mechanical transmission, each comprising coupling means movable, under the control of the mechanical store, between an inoperative position of uncoupling from the motor and an operative position of coupling of the motor.

The invention will be described in more detail, by way of example, with reference to the accompanying drawings.

DESCRIPTION OF THE PREFERRED EMBODIMENT

Figure 1:
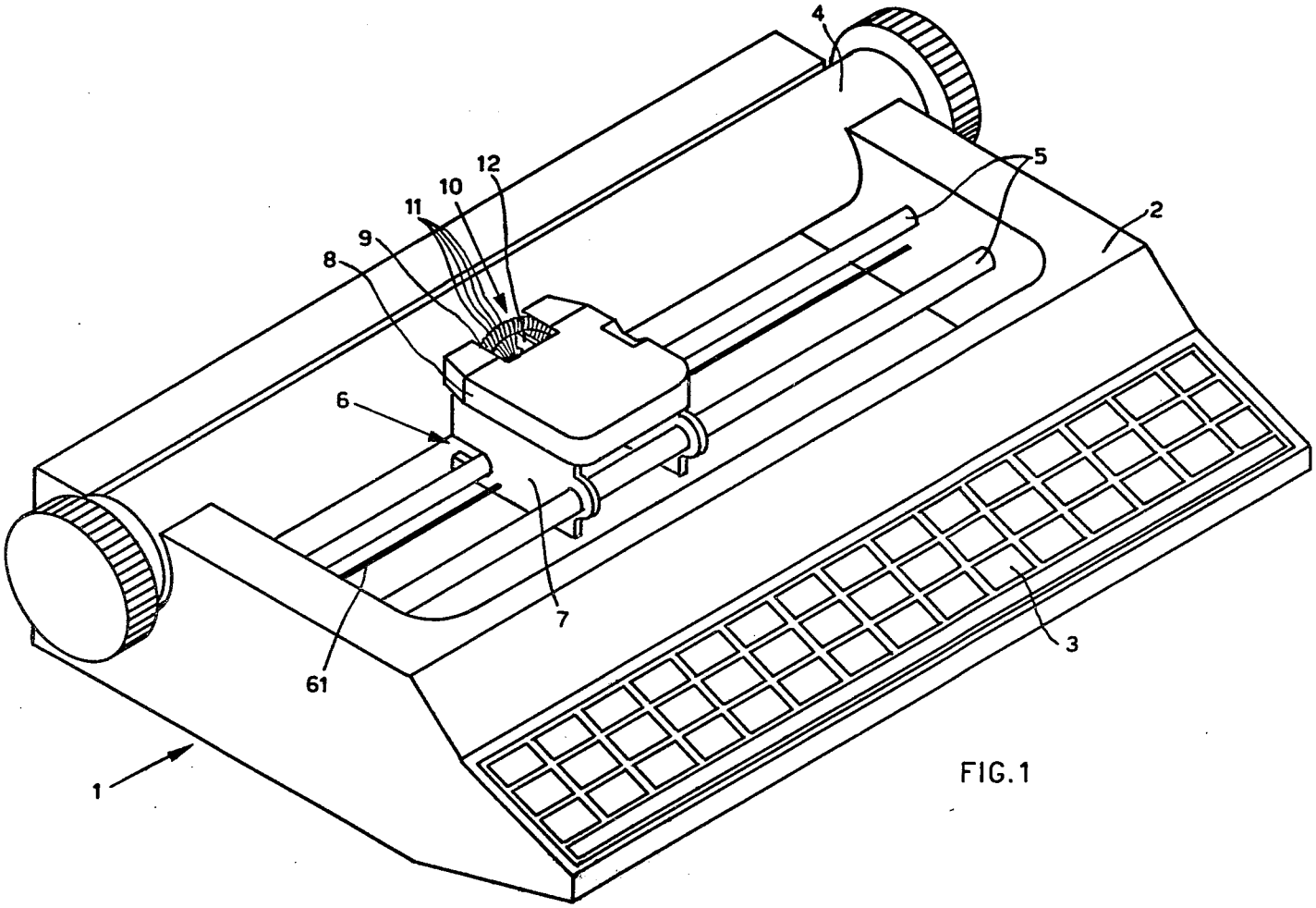
FIG. 1 is a diagrammatic perspective view of a portable typewriter comprising a printing unit embodying the present invention.
Figure 4:
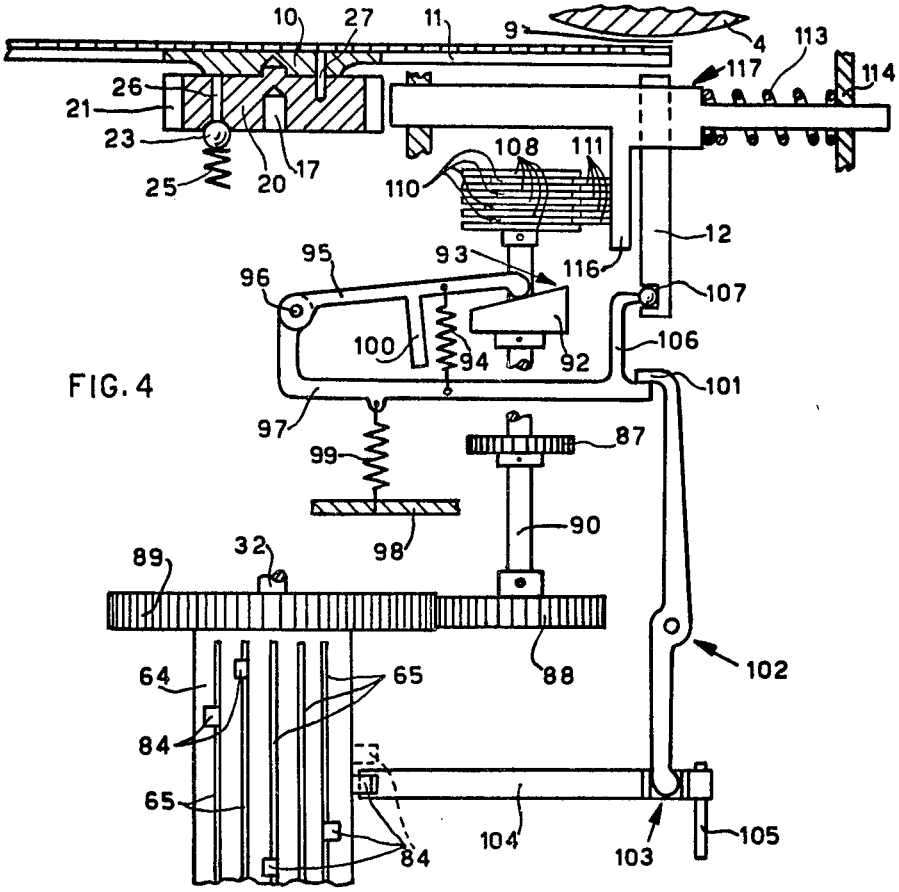
FIGS. 4 and 5 respectively illustrate, in a diagrammatic and functional manner, a second and a third group of mechanical elements housed inside the typewriter.

FIG. 1 shows a portable typewriter or casing comprising a frame/2 on the front part of which a keyboard 3 is arranged and on the upper part of which a platen 4 is rotatably mounted. In front of the platen 4, the frame 2 forms a hollow inside which there are disposed two bars 5 parallel to the platen 4 and defining a sliding guide for a printing assembly reference 6. The printing assembly has an outer cover 7 mounted slidably on the bars 5 and supporting a cartridge 8 for a printing ribbon 9 (FIG. 4) which emerges from the cartridge 8 and extends between the platen 4 and a type bearing element 10. In the example illustrated, the element 10 is constituted by a star-wheel supporting alphanumeric characters which is known per se and commonly called a daisy wheel, in which a group of radial arms 11 resiliently deformable in a direction transverse to their axis and commonly called "petals" each bear laterally, at their free end, a corresponding type or character arranged facing the platen 4. Each of the types is adapted to co-operate with the platen 4, with the ribbon 4 interposed, under the thrust of a hammer 12 acting on the respective petal 11, when the wheel is rotated to align that petal with the hammer.

In the example illustrated, the number of petals 11 and, therefore, of types or characters is equal to one hundred, ninetytwo of which are characters different from each other and eight are repeated characters chosen from among those most commonly used.

Figure 2:
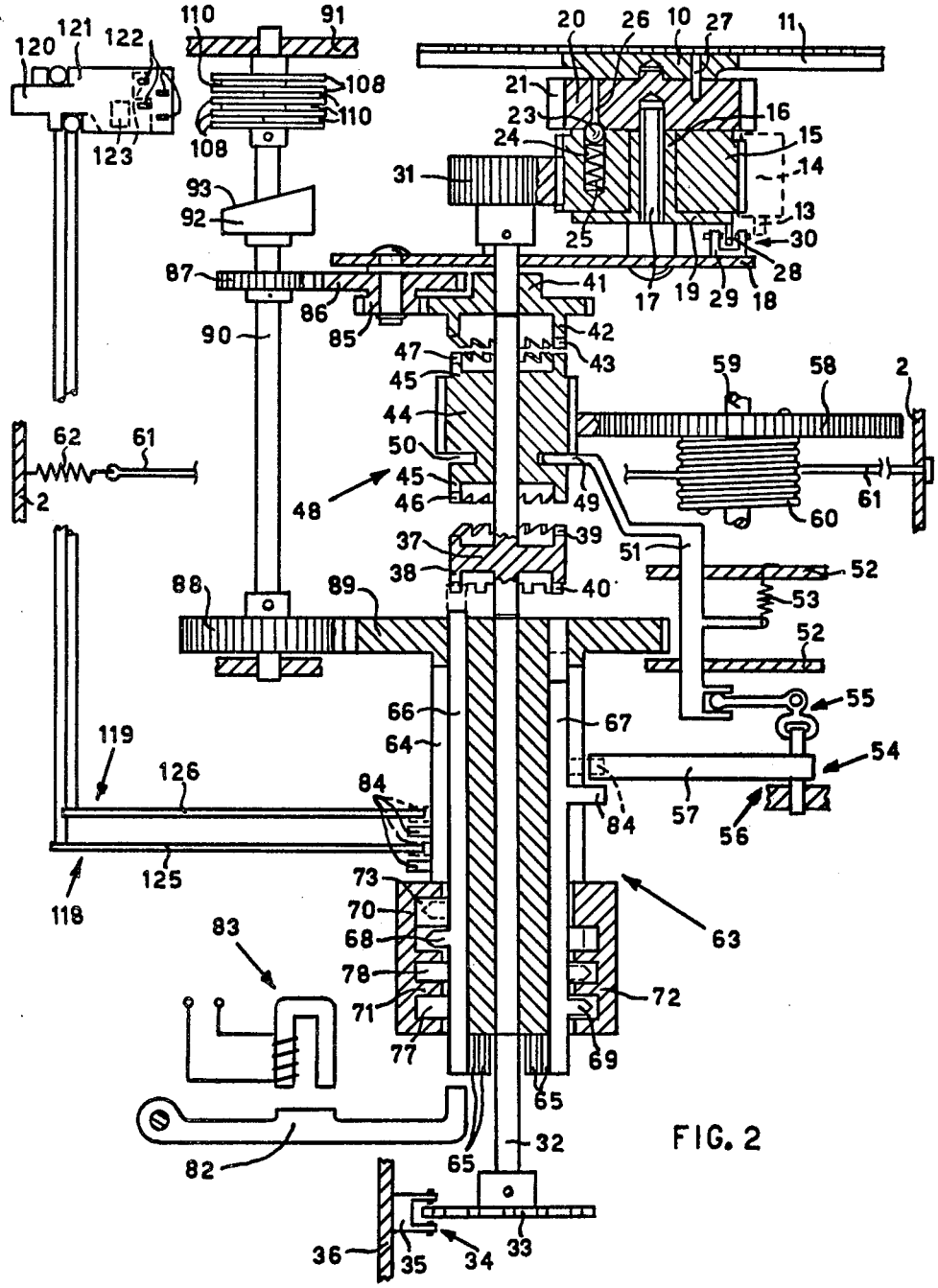
FIG. 2 illustrates in a diagrammatic and functional manner a first group of mechanical elements housed inside the typewriter.

In accordance with what is shown in FIG. 2, inside the cover 7 there is mounted a motor (not shown) an output shaft 13 of which actuates a pinion 14 coupled to an annular toothed wheel 15 mounted rotatably, by interposing a bush 16, on a pin 17 rigidly connected to a wall 18 of the cover 7. The toothed wheel 15 is located axially between an annular flange 19 of the bush 16 and another toothed wheel 20 having around it a predetermined number of teeth 21 (twenty-five in the example shown) of rectangular form. The wheel 20 is also mounted rotatably on the pin 17 and is coupled rotationally to the wheel 15 by means of a plurality of balls 23 each of which is partially housed inside a corresponding cylindrical axial recess 24 in opposition to the action of a corresponding spring 25 urging the respective ball 23 inside a corresponding axial recess 26 formed in the surface of the wheel 20 presented to the gear 15. In the example shown (see FIG. 5), the number of balls is five and they engage respective recesses 24 and 26 uniformly distributed around a circle coaxial with the pin 17.

To that surface of the wheel 20 which is remote from the wheel 15 the daisy wheel is rotationally connected by means of a pin 27.

From the periphery of the flange 19 there extends axially a projection 28 which, during the rotation of the wheel 15, passes between the facing arms of a U-shaped support 29 rigidly connected to the wall 18 and supporting on the said arms a photoelectric detector assembly 30, the conduction of which is interrupted by the passage of the projection 28.

Coupled to the toothed wheel 15 is a toothed wheel 31 keyed on one end of a shaft 32 supported rotatably by the wall 18 and bearing a toothed wheel 33 keyed at the other end and provided with a given number of radial teeth (ten in the example shown). The latter are adapted to interrupt periodically the conduction of a photoelectric detector assembly 34 carried by a support 35 rigidly connected to a wall 36 of the cover 7 and to each movement of the wheel 33 by one tooth there corresponds a movement of the toothed wheel 20 by two teeth 21.

A circular flange 37 extends radially outwards from a central portion of the shaft 32 and is integral at its periphery with the inner surface of a cylindrical sleeve 38 on a first end of which there is formed an axial toothing 39 comprising sawteeth and on the opposite end of which there is formed a toothing 40 comprising rectangular teeth. On a portion of the shaft 32 located adjacent the wall 18 there is mounted idly, in an axially fixed position, a toothed wheel 41 from the surface of which facing the toothing 39 there extends a tubular projection 42 having an axial toothing 43 comprising sawteeth and similar to the toothing 39. Between the toothings 39 and 43 is arranged a toothed wheel 44 mounted idly and slidable axially on the shaft 32 and having at its own opposite ends two tubular projections 45 presenting axial toothings comprising sawteeth indicated respectively by the reference 46 and 47 and adapted to mesh with the toothings 39 and 43 by means of axial shifting of the wheel 44 in one direction or the other along the shaft 32. The group or combinations of toothings 39, 43, 46 and 47 constitutes a frontal-tooth clutch 48, the actuating member of which is formed by a projection 49 engaged in an annular groove 50 formed in the wheel 44. The projection 49 extends laterally from a bar 51 parallel to the shaft 32 and supported by two plates 52 rigid with the cover 7 to slide axially with respect to these plates in opposition to the action of a spring 53 and under the thrust of a lever system 54 comprising two bell-crank levers 55 and 56 pivoted on respective pins perpendicular to one another and the lever 56 of which has an end arm 57 extending towards the shift 32 and perpendicularly thereto.

To the toothed wheel 44 there is coupled a toothed wheel 58 mounted idly on a spindle 59 fast with the cover 7 and having fast with it a cylindrical drum 60 on the outer surface of which there is formed a helical groove engaged by a wire 61 (see also FIG. 1) which emerges from the cover 7 and is anchored to the frame 2, directly on one side and with a spring 62 interposed on the other.

Rotational coupling between the shaft 32 and the toothed wheel 58 is controlled by a mechanical store 63 and comprising a cylindrical drum 64 mounted rotatably on the shaft 32 in an axially fixed position. The drum 64 has a plurality of uniformly distributed axial slots 65 (the number is twenty in the example shown) in which there are slidably mounted two different types of sliders indicated by the reference 66 and 67 respectively. Each of the sliders 66 and 67 is constituted by a bar from which there extends radially outwards a coupling tooth 68, 69, respectively, the coupling teeth being slidably engaged in respective annular guides 70 and 71 formed in the interior of a tubular body 72 coaxial with the shaft 32 and fast with the cover 7.

Although the function of the sliders will be more fully explained subsequently, briefly they are as follows:

There are two diametrically opposed sliders 66 each of which, when raised to the operative position, causes the drum 64 to effect a rotation of 180° during which various operations selected by the sliders 67 may be performed.

A print slider 67 selects either slot forward spacing of the printing assembly 6 or more rapid back spacing.

Two sliders 67 select which character is to be printed.

Another slider 67 triggers operation of the print hammer.

Other sliders 67 may activate a clutch selecting fast forward feed of the printing assembly 6 and a mechanism raising a correcting ribbon.

Figure 3:
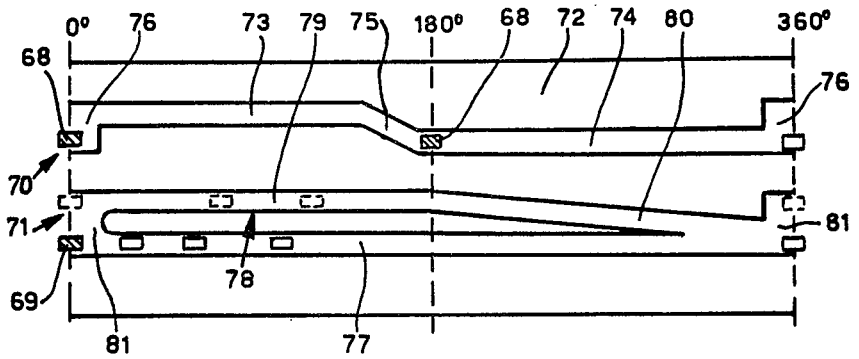
FIG. 3 shows the plane development of a detail of FIG. 2.

As illustrated in the plane development of FIG. 3, the guide 70 is constituted by a groove comprising two sections 73 and 74 axially offset from each other and connected at one end by an inclined section 75 and at the other end by an axial section 76 perpendicular to the sections 73 and 74. The guide 71, on the other hand, is constituted by two annular grooves 77 and 78, the first of which lies in a plane perpendicular to the shaft 32, while the other comprises a first section 79 parallel to the groove 77 and connected thereto on the one hand by an inclined section 80 and on the other hand by a section 81 perpendicular to the plane of the groove 77.

The ends of the sliders 66 and 67 facing the wheel 33 are adapted to be engaged axially by the end of an armature 82 of an electromagnet 83, the energization of which allows the shifting of the slider 66, 67 facing the armature 82 from an inoperative position (shown in solid lines in FIG. 2) to an operative position (shown in dash lines in FIG. 2), to which there corresponds a shifting of the tooth 68, 69 along the section 76, 81 of the respective guide 70, 71.

As shown in FIG. 3, the number of sliders 66 (denoted by their teeth 68) is two and they are mounted to slide along respective slots 65 disposed at 180° from one another; consequently, the teeth 68 of the two sliders 66 occupy positions spaced from one another by 180° along the corresponding guide 70 and only one of these sliders at a time can find itself in the operative position. When one of the two sliders 66 is shifted into the operative position by the armature 82, the end of the slider facing the clutch 48 engages the frontal toothing 40, rendering the shaft 32 and the drum 64 angularly fast with each other through the sleeve 38 and the flange 37 for a period of time corresponding to a rotation of the shaft 32 through 180°. In the course of this period, the ends of the sliders 67 present themselves serially in front of the end of the armature 82 and the sliders 67 can therefore be shifted from the inoperative to the operative position by means of an energizing signal sent to the electromagnet 83. Each slider 67 has a dog 84 extending outwards radially from the drum 64 and which, in the course of the rotation of the drum 64, sweeps respectively a first or a second annular portion of space which are adjacent one another and characteristic of each dog 84 and correspond respectively to the said inoperative and operative positions of the slider., 67.

More particularly, as shown in FIG. 2, the dog 84 of one of the sliders 67 is adapted to engage the arm 57 of the lever 56 and move the arm laterally to produce, through the medium of the lever 55, an axial movement of the bar 51 in opposition to the action of the spring 53 to bring the toothing 46 into engagement with the toothing 39, thus coupling the shaft 32 and the toothed wheel 58 angularly with one another.

Due to the presence of the spring 53, the bar 51 is normally held in an axial position such as to allow coupling between the toothings 47 and 43, which are then coupled rotationally to the shaft 32 through the medium of a gear chain comprising gears 85, 86, 87 and 88, in which the gear 85 is coupled to the wheel 41 and the gear 88 is coupled to a toothed wheel 89 keyed on the drum 64.

With regard to the foregoing, it is appropriate to note that, when the shaft 32 is coupled angularly to the wheel 58 through the drum 64 and the gear chain, to a half revolution of the shaft 32 there corresponds a rotation of the wheel 58 corresponding in turn to a forward movement of the printing assembly 6 by a single striking space, and that the transmission ratio between the wheels 89 and 88 is 2:1.

In the case where the shaft 32 is coupled angularly to the wheel 58 through the medium of the toothings 39 and 46, to one tenth of a revolution of the shaft 32 (corresponding to the passage of a tooth of the toothed wheel 33 between the extensions or arms of the support 35) there corresponds a rotation of the wheel 58 corresponding in turn to a backward movement of the printing assembly 6 by a single striking space.

Figure 5:
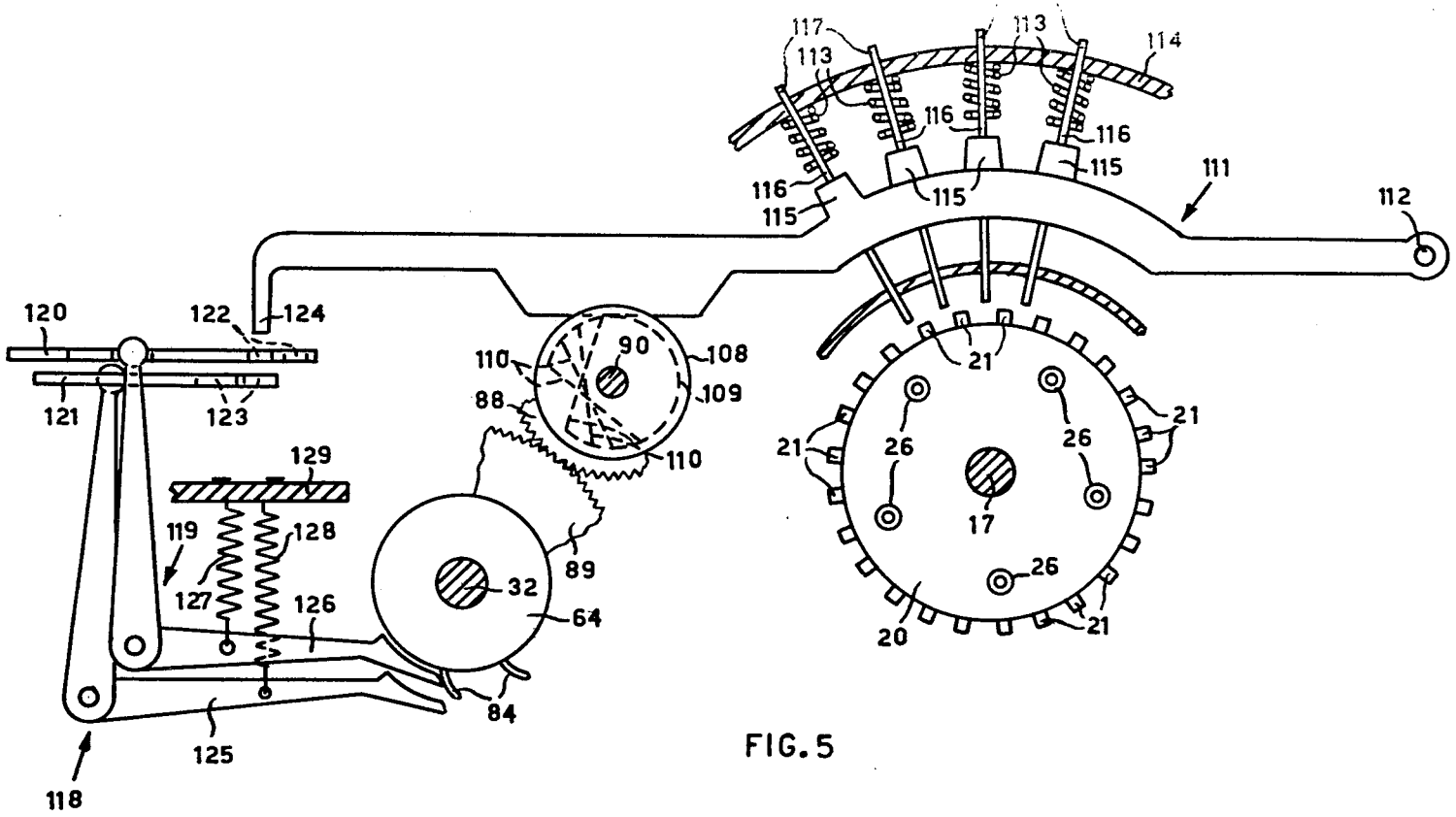

The gears 87 and 88 are keyed on a shaft 90 mounted rotatably in a wall 91 of the cover 7 and bearing, keyed thereto, a frontal cam 92 constituted by an inclined surface 93 on which bears, under the thrust produced by a spring 94 (FIG. 4), the end of a lever 95 pivoted on a pin 96 fast with the cover 7. To the pivot 96 there is moreover connected a bell-crank lever 97 connected to one side to the lever 95 by means of the spring 94 and on the other side to a wall 98 of the cover 7 by means of a second spring 99. The relative rotation of the levers 95 and 97, one with respect to the other, is limited by a projection 100 integral with the lever 95 and extending from the latter towards the lever 97. The free end of the latter engages an end detent 101 of a rocking lever 102, the end of which opposite that bearing the detent 101 is engaged in a fork 103 borne by a lever 104 adapted to be turned about a pivot 105 by engagement of the lever 104 with a dog 84 of a corresponding slider 67 disposed in the inoperative position. Connected to the lever 97 is a projection 106, the free end of which is engaged in a seat 107 formed in the hammer 12 which, on rotation of the lever 104 and consequent disengagement of the lever 97 from the detent 101, moves under the thrust of the spring 94 towards the display wheel 10. On the shaft 90 there is moreover keyed a plurality of discs 108 between which are received four substantially circular cams 109 each having a chordal portion 110 offset with respect to the corresponding portion 110 of the adjacent cam 109 by an angle of predetermined value (FIG. 5).

On each cam 109 there bears a central portion of a corresponding lever 111 pivoted on a pin 112 fast with the cover 7 and urged against the cam 109 by a compression spring 113 having a first end bearing on a wall 114 fast with the cover 7 and a second end acting on a shoulder 115 of the lever 111 through the medium of a tooth 116 of a rod 117 mounted radially with respect to the toothed wheel 20. Each rod 117 has an end facing the teeth 21 of the wheel 20 and can shift axially to engage the space between the two teeth 21 and consequently arrest the rotation of the wheel 20. Each rod 117 is mounted offset with respect to the preceding one by a whole number of teeth 21 (one in the example illustrated) plus a distance corresponding exactly ¼, 2/4, ¾ of the pitch between two teeth 21. In this way it is possible to arrest the wheel 20 (comprising twenty-five teeth 21) in one hundred different angular positions, each corresponding to a particular petal 11 of the daisy wheel 10, by interposing the end of one of the said four rods 117. The choice of a particular petal 11 and therefore the actuation of the rod 117 is effected by means of a positioning system comprising two bell-crank levers 118, 119 which act on two plates 120, 121 commonly known as "code bars". These plates have a plurality of holes 122, 123 the combination of which gives rise to a single through hole disposed facing a tooth 124 of each lever 111.

Each of the levers 118 and 119 comprises an arm 125, 126, respectively, movable in opposition to the action of springs 127, 128 connected at one end of the respective arms 125, 126 and at the opposite end to a wall 129 of the cover 7, the arm being adapted to be actuated by a dog 84 of a corresponding slider 67.

The possible combinations (four in the example illustrated) of the positions adopted mutually by the plates 120 and 121 actuated by the levers 118 and 119 each produce the opening of a hole in a position which is different and faces the tooth 124 of the corresponding lever 111, therefore allowing, at a predetermined instant and for a period of time defined by the respective cam 109, the arrest of the daisy wheel 10 with the particular petal 11 arranged in correspondence with the hammer 12. More particularly, this period of time corresponds to a rotation of the wheel 20 for 1/5 of a revolution, or for five teeth 21, which also corresponds to arrest of the daisy 10 for five groups or "modules" of four petals 11 of the daisy wheel 10.

Finally, in addition to the detector assemblies 30 and 34 which have been described, other detectors of photoelectric type (not shown) are provided. By means of one of these detectors arranged at the left-hand end of the travel that the printing assembly is allowed along the bars 5 there is detected the arrival or presence of the printing assembly 6 at this end.

Another of these detectors co-operates with the platen 4 and supplies electric signals denoting increments of the paper feed, and another photoelectric detector movable along a guide (not shown) and parallel to the bars 5 co-operates with a tooth (not shown) of the printing assembly 6 to supply an indication of a manually presettable margin.

Figure 6:
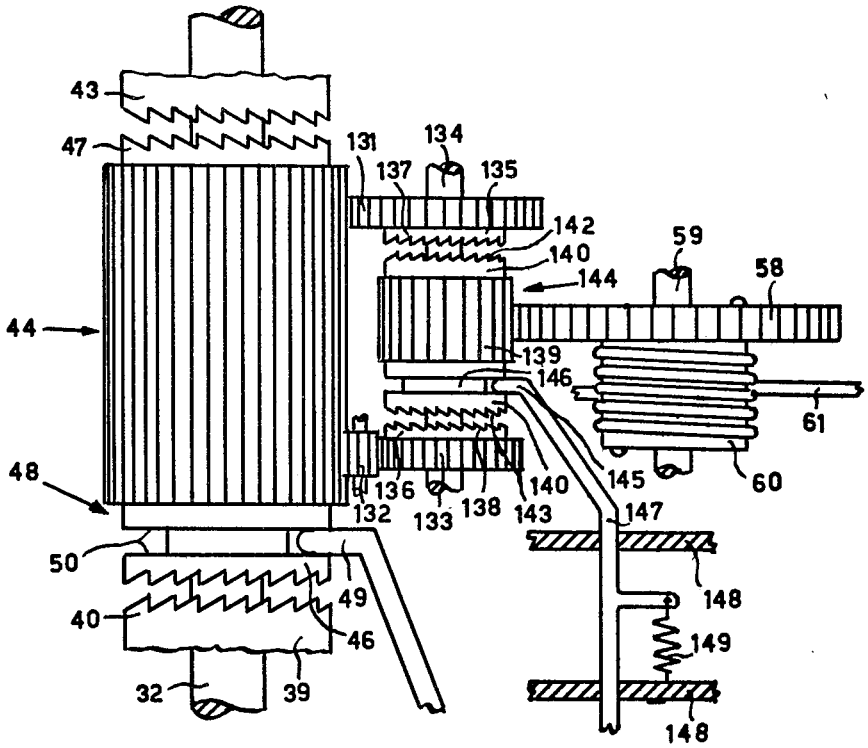
FIG. 6 illustrates in a diagrammatic and functional manner a modified form of a detail of FIG. 2.

FIG. 6 illustrates a modification in the system for transmitting motion from the clutch 48 to the toothed wheel 58. The toothed wheel 44 of the clutch 48 is coupled directly to a toothed wheel 131 and indirectly, by means of a motion reversing toothed wheel 132, to a toothed wheel 133.

The wheels 131 and 133 are mounted idly on a shaft 134 fast with the cover 7 and have on their facing surfaces, two projecting collars 135 and 136 having respective axial toothings 137 and 138 comprising sawteeth. Between the toothings 137 and 138 there is disposed a toothed wheel 139 coupled to the wheel 58 and mounted idly and slidably axially on the shaft 134. This wheel 139 has at its opposite ends two tubular extensions 140 presenting axial sawtoothed toothings 142 and 143 and adapted to mesh with the toothings 137 and 138 by means of the axial shifting of the wheel 139 along the shaft 134 in one direction or the other. The groups of toothings 137, 138, 142 and 143 constitutes a frontal-tooth clutch 144, the actuating member of which is formed by a projection 145 engaged in an annular groove 146 formed in the wheel 139. The projection 145 extends laterally from a bar 147 parallel to the shaft 134 and supported by two plates 148 rigid with the cover 7 to slide axially with respect to these plates in opposition to the action of a spring 149 and under the thrust of a lever system (not shown) similar to the lever system 54 of FIG. 2 and actuated by means of a respective dog 84 of a slider 67.

Due to the presence of the spring 149, the bar 147 is normally held in an axial position such as to allow coupling between the toothings 138 and 143, which are coupled angularly to the toothed wheel 44 by means of the toothed wheels 133 and 132. Under these conditions, the wheel 58 makes forward and back-spacing movements, as already described. If the wheel 58 is coupled to the wheel 44 through the toothings 140 and 142 of the clutch 144, there is obtained a reversal of the direction of rotation induced in this wheel 58 and, in particular, when at the same time the shaft 32 is coupled angularly to the wheel 44 through the toothings 39 and 46, to one tenth of a revolution of the shaft 32 (corresponding to the passage of a tooth of a toothed wheel 33 between the extensions or arms of the support 35) there corresponds a rotation of the wheel 58 corresponding in turn to a forward movement of the printing assembly 6 by a single striking space. This provides fast forward movement.

Figure 7:
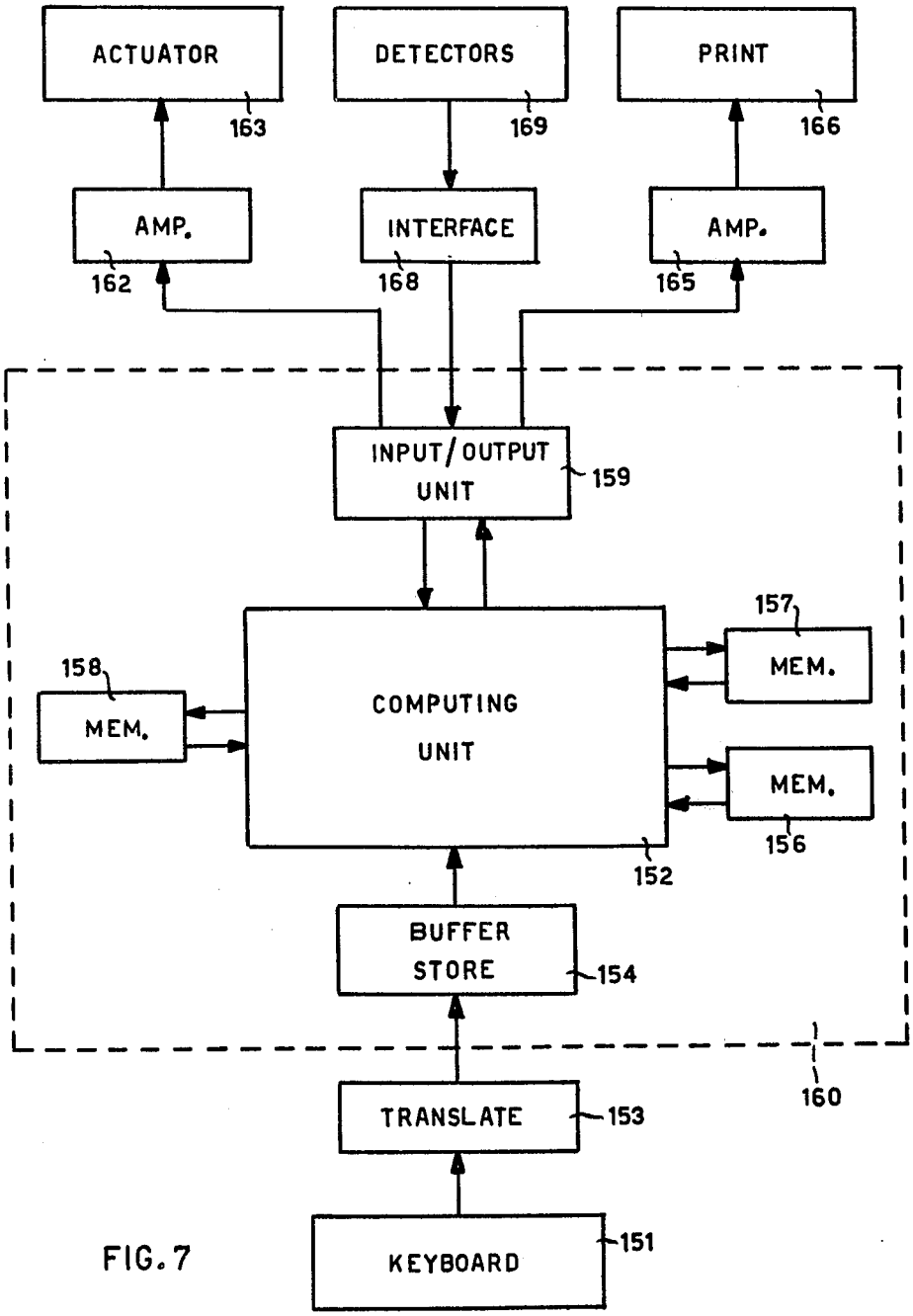
FIG. 7 shows diagrammatically in block form an electronic control circuit for the printing unit.

With reference to FIG. 7, a unit 151, comprising the keyboard 3 of the typewriter 1, has an output at which there are present electric signals representing the characters keyed in an keyboard 3, which output is connected to an input of a computing unit 152 via a signal adapting and translating unit 153 arranged in seris with a buffer store 154 for storing the electric signals. The computing unit 152, comprising, for example, a microprocessor, has pairs of inputs and outputs connected to the outputs and inputs, respectively, of three logical memories 156, 157 and 158 and to an input/output unit 159, with which memories and input/output unit, together with the buffer store 154, it defines a central processing unit 160. In the memory 156 there is contained fixed data (programs, subprograms, disposition of the characters on the petals 11 of the daisy wheel 10, etc.) stored once only and which backs up the computing unit 152 for correct functioning thereof. The memory 157 can contain changeable data and in particular data relating to temporary computing functions centered by means of the keyboard 3, which data is not prevented in the memory 157 when the supply voltage is absent. Finally, the memory 158, which, according to the services required of the machine, may or may not be connected, contains data enterable from outside by means of the keyboard 3 (for example, arrangement of the left-hand and right-hand margins, tabulation, etc.) or internal data (for example, a sequence of characters printed in the course of the typing of a line) which, however, is kept stored even if the supply voltage is absent and can be modified only in consequence of an external command.

A first output of the unit 159 is connected through an amplifier 162 to an input of a unit 163 commanding a first actuator assembly (not shown) for functions requested through the keyboard 3, for example rotation of the platen 4 through a certain angle, normally indicated by the term "line-spacing", corresponding to a movement of the typing paper of a predetermined value.

A second output of the unit 159 is connected through an amplifier 165 to an input of a unit 166 commanding the printing assembly 6 (FIG. 1) and more particularly sends command signals to the electromagnet 83 and to the motor whose shaft 13 is shown in FIG. 2.

Finally, electric signals arrive at another input of the unit 159 through an interface unit 168 from an output of a block 169 comprising, for example, the photoelectric assemblies 30 and 34 and the other assemblies (not shown) for the detection of particular positions adopted by the first actuator assembly and by the printing assembly 6 in the course of their operation.

Figure 8:
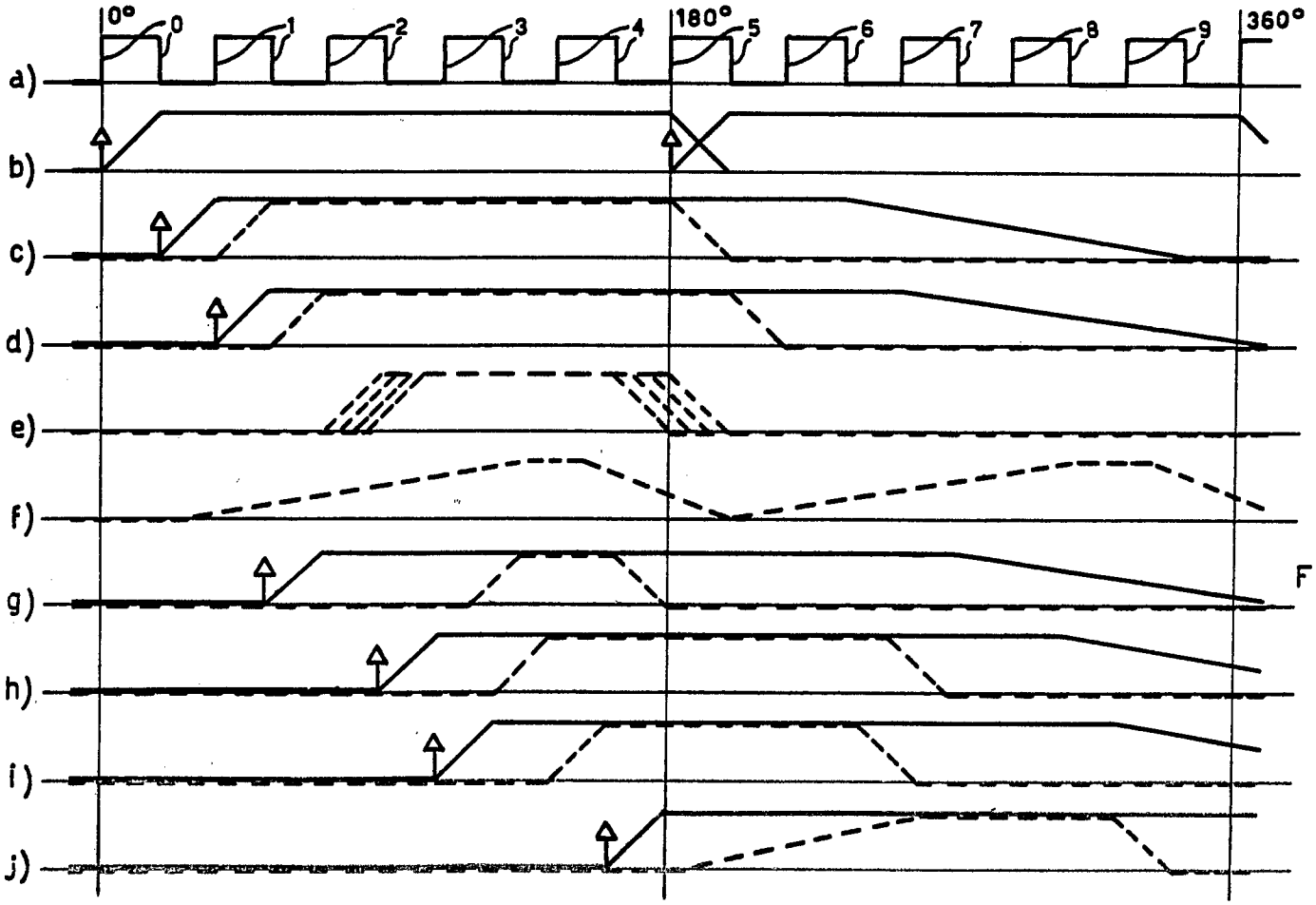
FIG. 8 shows a plurality of functional diagrams of the printing unit.

With reference to FIG. 8, FIG. 8*a* shows the course of the electrical signal obtained at the terminals of the detector assembly 34 and with the leading and trailing edges numbered progressively from 0 to 9, when the drum 64 performs a complete revolution of 360° and, thereby, also the toothed wheel 33. In correspondence with the letters (b) to (j) there are illustrated waveforms in which the arrows indicate an electric command signal sent to the electromagnet 83 by the unit 166 in coincidence with one of the edges of the electric signal shown in FIG. 8*a*. The solid lines indicate the passage of the sliders 66 and 67 from the inoperative position to the operative position and the dash lines indicate in correspondence the stages of engagement of the arms of the various levers described hereinbefore by the dogs 84 of the sliders 67.

More particularly, FIG. 8*b* shows an example of actuation of the sliders 66 which, respectively positioned in correspondence with the leading edge "O" of the electric signal of FIG. 8*a*, couple the toothing 40 of the shaft 32 angularly with the drum 64, allowing the latter two consecutive rotations of 180°.

FIGS. 8*c* and 8*d* respectively show the positioning of the two sliders 67 the dogs 84 of which are engaged by the arms 125 and 126, respectively, of the levers 118 and 119 for command of the arrest of the daisy wheel 10.

FIGS. 8*e* and 8*f* respectively show the period of arrest of the wheel 20 for allowing the striking of a type and the corresponding stages of loading and release of the spring 94 by the frontal cam 92 for command of the hammer 12.

Finally, FIGS. 8*g*, 8h, 8*i* and 8*l* show in order the command signals and the relative positionings of a plurality of sliders 67, the dogs 84 of which are respectively adapted to command engagement of the hammer 12, coupling between the toothings 137 and 142 of the clutch 144, coupling between the toothings 39 and 46 of the clutch 48 and interposition of a correcting ribbon (not shown) between a petal 11 and the platen 4.

The operation of the typewriter 1 will first be examined with particular reference to the mechanical parts of the printing assembly 5 which are illustrated in FIGS. 1 to 6, and then, referring also to FIG. 7, there will be described the manner in which the printing assembly 6 performs a number of principal functions requested of it through the electronic control system on FIG. 7.

The supply of motion of the various mechanisms described takes place through the pinion 14 connected to the driving shaft 13. Via the toothed wheels 15 and 31, this pinion 14 transmits the motion to the shaft 32 and to the toothed wheel 20, with which the sleeve 16, with the annular flange 19 and the projection 28, and the daisy wheel 10 rotate, being fast therewith.

Under these conditions, electric signals are emitted by the photoelectric detector assemblies 30 and 34 mounted on the supports 29 and 35, the course of which, insofar as the detector 34 is concerned, is shown in FIG. 8*a*.

Moreover, the toothings 43 and 47 of the clutch 48 are coupled to one another, but are not in motion, since the drum 64 is mounted idly on the shaft 32 and consequently does not transmit the motion to mechanisms coupled to it.

Actuation of one of the two sliders 66 by the armature 82 of the electromagnet 83 produces the engagement of one end of this slider in the toothing 50 of the circular flange 37 and a consequent angular coupling between the shaft 32 and the drum 64 for a period of time corresponding to a rotation by the drum 64 itself for half a revolution, During this period there are systematically performed the services of slow forward movement of the printing assembly 6 by one striking space or step, loading of the spring 94 for striking, and release of the hammer 12.

More particularly, in accordance with what has already been partly described, the forward movement of the printing assembly 6 by one step is obtained by coupling between the shaft 32 and the wheel 58 through the aforesaid gear chain; the loading of the spring 94 is produced through the rotation of the shaft 90 and the corresponding frontal cam 92, while the release of the hammer 12 is systematically obtained through the medium of the detent 101 of the rocking lever 102 actuated by the lever 104, which is engaged in turn by the dog 84 of a corresponding slider 67 disposed in the inoperative position. In this respect it may be observed, in fact, how it may be more convenient to prearrange the striking action of the hammer 12 in a systematic manner and leave the order for release or non-release to an external command signal, the ratio between strikings and spacings being generally much higher than one.

During the rotation of the drum 64 for half a revolution, the arrest of the wheel 20, and therefore of the daisy wheel 10, is produced by the end of one of the rods 117 and for a total of time corresponding to the said five modules.

More particularly, referring to FIGS. 8*a* and 8*e*, this arrest is established from the fourth edge of the signal of FIG. 8*a* and, in view of the correspondence between the rotation of the toothed wheel 33 and the rotation of the toothed wheel 20, it takes place after a period corresponding to the passage of four teeth of the toothed wheel 20, or four modules after the instant of actuation of the slider 66. The arrest of the wheel 20 for five modules then takes place in the manner described hereinbefore with reference to FIG. 5.

The phasing and the shape of the cams 110 and their action with respect to the wheel 20 allow the descent of each of the rods 117 between two teeth 21 of the wheel 20 in a period of time which elapses each time from the instant when the end of the rod is located in correspondence with the outer surface of the tooth 21 preceding the one which is to be arranged, so as to be able to have available for this descent all the time that elapses between the passage of two consecutive teeth 21 in front of the end of the rod 117.

Moreover, as has already been specifically mentioned, during each period of arrest of the daisy wheel 10 the motor continues its own rotation and produces a rotation of the toothed wheel 15 for one fifth of a revolution. In the course of this period, the balls 23 are pushed inside the corresponding cylindrical recesses 24 by the facing surface of the toothed wheel 20 and in opposition to the action of the springs 25; at the end of the said period, the balls 23 engage the respective recesses 24 and 26 again to carry along once more in rotation the wheel 20 and with it the daisy wheel 10.

Generally, the arrest of the wheel 20 takes place systematically at each rotation of the drum 64 for half a revolution, since by the combination of the possible positions of the holes 122 and 123 there is always produced a through hole which receives the corresponding tooth 124 facing it of one of the levers 111 and consequently brings about the positioning of one of the petals 11. In the event, however, of it not being desired to effect striking, it is sufficient to send a command signal to the electromagnetic 83 (FIG. 8*g*), which shifts into the operative position that one of the sliders 67 whose dog 84 actuates in its inoperative or rest position the lever 104 (FIG. 4), so as to keep the lever 97 engaged by means of the rocking lever 102.

In the event of it being desired to obtain a backward movement of the assembly 6, it is necessary, by actuating the electromagnet 83 (FIG. 8*i*), to bring into the operative position the slider 67 whose dog 84 produces by means of the lever system 54 an axial movement of the toothed wheel 44 of the clutch 48 so as to couple the toothings 39 and 48 and, therefore, the toothed wheel 58 directly to the shaft 32 (FIG. 2). On the basis of the transmission ratios indicated for this coupling, return of the printing assembly 56 is obtained at a speed five times greater than the forward movement. Finally, referring to FIG. 6, in the event of it being desired to obtain rapid advance of the printing assembly 6, it is sufficient to reverse the direction of rotation appertaining to the above-described condition of rapid return by bringing into the operative system, in addition to the slider 67 for setting rapid return, also a slider 67 the dog 84 of which produces, through the medium of the lever system actuating the bar 147, coupling between the toothings 142 and 137 of the clutch 144, with consequent transformation of the rapid return movement into forward rapid movement of the assembly 6. In this case also therefore, the forward movement of the assembly 6 takes place at a speed five times greater than that corresponding to the forward movement by one step hereinbefore described. More particularly, referring to FIGS. 8*h* and 8*i*, the command signals to the electromagnet 83 must preferably be given as indicated, so as proceed first with reversal of the direction of rotation, by actuating the clutch 144, and then with coupling of the wheel 48 to the shaft 32, so as to avoid excessive stresses and consequent possible damage or possible failure to effect coupling between the toothings concerned.

With particular reference to FIGS. 7 and 8 there will now be examined examples of performance of a number of principal functions required of the printing assembly 6, such as, for instance, selection and printing of a character, advance by one step, return by one or more steps, rapid forward tabulation by several steps and automatic or manual erasure.

To be able to carry out the desired function, the central unit 160 must cause the motor of the printing assembly 6 to rotate or keep it in rotation and, to this end, sends a command signal to this motor through the amplifier 165 and the command block 166. Consequently, there are supplied to the central unit the electric signals of the photoelectric detector assemblies 30 and 34 and of the other detector assemblies (not shown), which inform it concerning the position adopted by the petals 11 of the daisy wheel 10 with respect to the hammer 12 and by the printing assembly 6 with respect to the frame 2 of the machine 1.

Each function requires for its own performance a whole number of 180° rotations of the drum 64 and the whole of the operations performed within the periods corresponding to these rotations will be referred to hereinafter as a "function cycle".

More particularly, FIG. 8 shows two function cycles during the first for which electric command signals (indicated by the arrows) are supplied in synchronism with the signals of FIG. 8*a* to the electromagnet 83 for shifting the sliders 66 or 67. Therefore, by energizing or not energizing the electromagnet 83 during the execution of the cycle, different combinations of the sliders 67 can be obtained, and therefore likewise different corresponding functions.

In the embodiment illustrated, the slider 66 corresponding to engagement of the drum 64 with the shaft 32 can be actuated in correspondence with the edge of the signal in FIG. 8*a* indicated by 0; the sliders 66 and 67 which command the arrest of the daisy wheel 10 can be actuated in correspondence with the edges 1 and 2; in correspondence with the edge 3 a signal can be sent which acts on the slider 67 connected with the release of the hammer 12, preventing the release thereof. Finally, in correspondence with the edges 5 and 6, sliders 67 can be actuated which correspond to the movements of the toothed wheels 139 and 44 respectively for command of the change of direction and of the slow or fast speed of rotation of the toothed wheel 58, while in correspondence with the edge 9 a slider 67 can be enabled which, through a mechanism (not shown) produces the raising of the ribbon which permits erasure of a previously printed character.

We will now examine in detail the operations relating to the selection and printing of the first character of a sequence of several characters. The signal relating to this first character arrives from the keyboard 3 at the computing unit 152 through the units 153 and 154. This signal is compared with the signals stored in the memory 156 and corresponding to the one hundred characters of the daisy 10, on the basis of which it is established in which group or module the character is contained and in which of the four possible positions within the module the required character is arranged.

These operations having been carried out, the motor is set in motion to receive a first electric signal from the detector assembly 30 angularly coupled to the daisy wheel 10.

From the instant of reception of this first signal, there are counted all the edges of the signal received from the detector assembly 34 which are previously computed by the central unit 160 for reaching the module from which must start a function cycle for carrying out the striking of the required character. More particularly, since the arrest of the daisy wheel 10 takes place after four modules from the beginning of this cycle, it is necessary to cause the cycle to start four modules in advance with respect to the module which must actually be positioned; to this end; it is sufficient to shift in advance by four modules the position of the projection 28 located on the flange-like wall 19 rotating fast with the toothed wheel 20.

The function cycle for the striking of the selected character is then caused to start by acting on the electromagnet 83 to engage the drum 64 with the shaft 32 by means of the slider 66 and shift or not shift the sliders 67 relating to command of the plates 120 and 121 for the choice of the petal 11 on which the required character is located. The cycle lasts for ten modules, during which there are performed the systematic services of striking and advance by one step hereinbefore described and, moreover, the feed and raising of the printing ribbon 9 by means of a mechanism (not shown).

A character following the first character is temporarily stored inside the block 154 and is extracted therefrom by the computing unit 152 for carrying out thereon all the operations performed for the first character. More particularly, the value of the module at which the daisy wheel 10 has stopped for the printing of the preceding character is still contained in the memory 157. On the basis of this datum, the computing unit 152 is able to establish how many modules must be passed through to initiate a fresh function cycle for the striking of the said following character and in which position within the new module the character itself is located.

These operations having been carried out, the unit 152 effects the counting of the number of edges of the signal supplied by the photoelectric detector assembly 34, each corresponding to one module, and, the required module having been reached, energizes the electromagnet 83, which allows engagement of the drum 64 with the shaft 32 and then produces the starting of a fresh function cycle similar to that described with reference to the striking of the first character.

In the case where the function requested by the keyboard 3 is an advance of the printing assembly by one step, the central unit 160 can immediately give effect to a cycle corresponding thereto, in which, in addition to the engagement command, a command signal must be sent to the electromagnet in correspondence with the third edge (FIG. 8*g*) of this cycle to avoid release of the hammer 12 taking place.

Let it now be assumed that the function required is the return of the printing assembly 6 by one step. This function is achieved in two consecutive cycles and, more particularly, in the first cycle the electromagnet 83 is energized at the edge O for engagement of the drum 64 with the shaft 32, at the edge 3 (FIG. 8*g*) to prevent striking, and at the edge 6 (FIG. 8*i*) to prearrange reversal of the direction of rotation of the toothed wheel 58 and, therefore, of the direction of movement of the printing assembly 5. In the second cycle, the signal must be given again at the edge 0 (engagement of the drum 64) and at the edge 3 to prevent striking. In this way, the movements induced a backward movement by one step, at the end of which the said assembly 6 is again prearranged for a slow advance.

In the case where the function required is a backward movement for a number of steps N this function is carried out by the performance of a cycle comprising an initial part and a final part which are entirely like the first and second cycles described for return by one step and between which there is included an intermediate part in which must be counted a number of edges of the signal supplied by the photoelectric detector assembly 34 which are equal to (2n−1). In fact, the initial part and the final part correspond substantially to return by one step, while for the reasons of a structural nature that have been mentioned, when the toothed wheel 58 carries out a backward and rapid movement, each step backward is effected at two edges of the signal of the photoelectric detector assembly 34.

Rapid forward tabulation by N steps is possible only if the assembly 6 is provided with modification shown in FIG. 6. This function is performed by means of a cycle comprising an initial part, in which there are prearranged striking at the third edge (FIG. 8*g*), changing of the direction of movement at the fifth edge (FIG. 8*h*) and the rapid engagement command at the sixth edge, for the purpose of prearranging a rapid forward movement of the assembly 6, and a final part in which non-striking is commanded at the third edge and which serves for restoration of the slow advance condition. As a whole, the initial and final parts produce a rapid advance by two steps, so that, in the intermediate part included between them, a number of edges of the signal supplied by the photoelectric detector assembly 34 eaual to (2N−2) will have to be counted, since also in this case a rapid step forward is effected in the time required for the passage of two edges of the signal of the photoelectric detector assembly 34.

The function of automatic erasure can be performed only in a typewriter 1 which also comprises the memory 158, in which the contents of a line of print are stored progressively each time.

When it is decided to erase one or more characters of the line which is being typed, it is necessary to set the printing assembly 6 so as to fix or mark the character to be erased and then strike on the machine a corresponding key for erasure. To perform this operation, the central unit 160 must cause the execution of a first cycle of return by one step and a second cycle in which non-striking is set at the third edge and a correction command signal is set at the ninth edge (FIG. 8*j*).

At this point, the central unit 160, comparing the character contained in the memory 158, effects selection of this character and a following striking cycle in which, however, the said correcting ribbon (not shown) is interposed in place of the printing ribbon 9.

Afterwards, return by one step is effected by means of two cycles like those described above for the performance of this function separately.

In the case in which the machine 1 is not provided with the memory 158, it is nevertheless possible to effect erasure of a character by also actuating, in addition to the erasure key, a key corresponding to the character it is desired to correct. In this case, the central unit 160 will extract the character to be erased from the block 154 instead of the memory 158.

In addition to the functions described above in detail, it is possible to cause a series of other functions to be performed, such as, for example, the printing of a character without advance, rapid return of the printing assembly 6 with respect to a manually set margin and, finally, a line-spacing operation.

More particularly, the printing of a character without advance will be understood by the central unit 160 as a request for two consecutive functions, that is, selection and printing of a character and return by one step.

Return of the printing assembly with respect to a manually set margin takes place by subjecting the central unit 160 to control by a command signal coming from the said photoelectric detector movable axially and parallel to the bars 5 until such time as the required positions is reached.

Finally, by placing the central unit 160 under the control of the photoelectric detector co-operating with the platen 4, line-spacing of the platen 4 of a predetermined value can be commanded.

From all the characteristics set forth it is clear how the present invention allows the disadvantages presented by typewriters of known type to be overcome.

More particularly, the number of actuating means is reduced to a minimum value, these actuating means comprising, in this specific case, a motor, an electromagnet, a cylindrical drum and a plurality of kinematic chains for mechanical transmission (toothed wheels, clutches, etc.).

More particularly, the drum 64 and the major part of the toothed wheels and clutches described can be made of plastics material, therefore permitting a considerable reduction in specific cost.

Because of the considerably limited number of actuating means, assembly times for the printing assembly 6 are also considerably reduced and as a whole allow production of the typewriter at a considerably restricted cost. In addition, the weight of the machine is reduced with respect to known machines, so that it is possible to produce a portable version which is particularly light and has a performance not inferior to that of these machines.

Finally, it is possible to utilize the capacity of the memory 158 to introduce therein groups of words in common use and recurring particularly, for example, in business letters, which can be called up automatically and printed by actuation of a single key of the keyboard 3 corresponding to them.

Finally, it is clear that modifications to the described embodiments can be made which do not depart from the scope of the invention as claimed.

For example, it is possible to perform further functions additional to those mentioned, since the maximum member of sliders 66, 67 used (seven) is less than the number of slots (ten) in the drum 64, which, with suitable adaptation of the signals supplied by the central unit 160, can be varied in number and if necessary increased.

The number of petals of the daisy wheel 10 may also be different from one hundred and in any case it is possible to duplicate those characters which, for any language, have a greater frequency of repetition, so as to increase the speed of selection of the particular character required. The position of the four characters within each module may moreover be chosen on the basis of the dimensions of the character itself in order to be able to carry out striking actions of different intensities; for example, it is possible to introduce a mechanism actuated by the plates 120 and 121 and which, according to the particular relative position assumed by these plates, produces in correspondence the insertion of compensating springs of different value for progressively reducing the striking force of the hammer 12 according to the position of the character within each module, so as to obtain four different levels of striking intensity which are actuated automatically.

Moreover, in the event of a greater speed of entry or setting of the described functions being desired, the sliders 66 and 67 of the drum 64 could be actuated simultaneously by as many electromagnets each associated with a corresponding slider.

Finally, it is clear that, even through the invention in question has been described with particular reference to use for a typewriter, it is possible to use the printing assembly 6 by itself or with other similar or different assemblies for any printing terminal unit of any data processing or receiving system.

What I claim is:

1. A printing unit, comprising a fixed guide, a printing assembly movable along the guide and comprising a type bearing element, and actuating means adapted to actuate the type bearing element and to shift the printing assembly along said guide to cause the printing assembly to perform a given number of functions, and electronic control means for the actuating means, wherein the actuating means comprise a motor, a mechanical store, at least one electromechanical transducer acting as an interface between the electronic control means and the mechanical store, and a plurality of kinematic chains for mechanical transmission, each comprising coupling means movable, under the control of the mechanical store, between an inoperative position of uncoupling from the motor and an operative position of coupling to the motor, wherein the mechanical store comprises a cylindrical drum rotatable about its own axis and having a plurality of axial slots in which there are slidably mounted a first and a second type of sliders movable, as a result of the actuation of the said electromechanical transducer, between two positions corresponding to the inoperative and operative positions, wherein the first and second types of movable sliders each have a radially corresponding extending coupling tooth slidably engaged in a first and second annular guide, respectively, formed in the interior of a tubular body coaxial with respect to the drum and with respect to which the drum is mounted rotatably, and wherein there are two sliders on the first type, disposed in two of the slots which are diametrically opposed, the first annular guide housing the coupling tooth of each first type slider comprising a groove having two axially offset sections connected at a first end by an inclined section and at a second end diametrically opposed to the said first end by an axial section perpendicular to the two offset sections.

2. A printing unit according to claim 1, wherein the second annular guide housing the coupling tooth of each second type slider comprises a first annular groove and a second groove having a first section extending parallel to the said first annular groove over an angle greater than 180° and connected to the first groove at one end by an inclined section and at the opposite end by a section perpendicular to the plane defined by the first groove.

3. A printing unit according to claim 2, wherein there is a plurality of sliders of the second type, each of said second type sliders having a corresponding dog extending outward radially and arranged axially in such a manner as to sweep respectively first and second annular portions of space adjacent one another and characteristic of the said dog and corresponding to housing of the coupling tooth in the first and the said second groove, corresponding in turn to the said inoperative and operative positions.

4. A printing unit according to claim 3, wherein the radial dog of a first slider of the second type sliders allows, in the inoperative position, the positioning of a first clutch element engaging a first mechanical transmission chain which produces a slow forward movement of the printing assembly by at least one printing step, and, in the operative position, actuates the first clutch element to engage a second mechanical transmission chain causing a backward movement of the printing assembly by at least one printing step and at a speed higher than that of the slow forward movement.

5. A printing unit according to claim 4, wherein the radial dog of a second slider of the plurality of second type sliders produces, in the operative position, the positioning of a second clutch element through which is caused a reversal of the backward movement, producing a consequent forward movement of the printing assembly at a speed higher than that of the slow forward movement.

6. A printing unit according to claim 3, wherein the type bearing element is constituted by a character wheel having a plurality of resiliently deformable radial appendages each bearing a corresponding character at a free end, and wherein the type bearing element is coupled angularly to a first toothed wheel coupled rotationally in a releasable manner to a shaft of the motor, the first toothed wheel being arrestable in a predetermined angular position through the medium of arresting means actuated by a mechanism for decoding the respective inoperative and operative positions of the radial dogs of a third and a fourth slider on the plurality of second type sliders.

7. A printing unit according to claim 6, wherein the first toothed wheel has a number of radial teeth equal to a submultiple to a factor of four of the number of the radial appendages and the arresting means comprise four rods movable radially by means of respective actuating levers with respect to the axis of the toothed wheel to engage a portion of space defined between two teeth of the first wheel, the four rods being progressively offset with respect to one of them by an angle proportional to one fourth, two fourths and three fourths of the said portion of space.

8. A printing unit according to claim 7, wherein the number of radial appendages is one hundred.

9. A printing unit according to claim 7, wherein the decoding mechanism comprises two plates having a plurality of holes and the relative position of which is established by the inoperative or operative positions of the radial dogs of the third and fourth sliders, each of the said relative positions producing, by combination of the said plurality of holes, a single through hole which, being engaged by a facing tooth of the corresponding lever, causes a rotation of the lever and a consequent radial shifting of the respective rod.

10. A printing unit according to claim 6, wherein the releasable coupling is provided by means of at least one ball which is housed in a first recess in one of the first and a second toothed wheel coupled rotationally to the shaft of the motor and is movable into the recess in opposition to the action of a spring, the spring urging the ball inside a corresponding second recess of a plurality of axial recesses uniformly distributed around a circle on a surface of the other of the first and second toothed wheels.

11. A printing unit according to claim 10, wherein the number of the second axial recesses is five.

12. A printing unit according to claim 6, wherein the radial dog of a fifth slider of the plurality of second sliders allows, in the inoperative position, release of a mechanism actuating a hammer acting as one of the radial appendages of the character wheel to cause a striking action of a type, and, in the operative position, a disabling of the hammer actuating mechanism.

13. A printing unit according to claim 12, wherein the hammer actuating mechanism comprises a first and a second lever interconnected by a spring, one end of the first lever being supported on an inclined surface of a frontal cam rotated about its own axis and coupled rotationally to the shaft of the motor, and one end of the second lever engaging in a corresponding seat of the hammer, a movement of the second lever being controlled by means actuated by the radial dog of the fourth slider.

14. A printing unit according to claim 3, wherein the radial dog of a sixth slider of the plurality of second sliders allows, in the operative position, actuation of a correcting ribbon.

15. A printing unit according to claim 4, wherein actuation of the first and second types of movable sliders takes place serially through the medium of a plurality of consecutive energizations of one electromechanical transducer by the electronic control means.

16. In a printing device comprising a platen, a printing assembly movable on a guide along the platen and including a type bearing element and a hammer for printing a desired type of said type bearing element, and actuating means for controlling the selection of said desired type and the operation of said hammer and a given number of functions of said assembly, the combination comprising kinematic chains actuatable for operating said hammer and the given number of functions of said printing assembly, a motor shaft for selecting the types of said type bearing element, a movable mechanical store including a plurality of command elements associated to said hammer and to said given functions and movable between an inoperative and an operative position, at least one transducer disposed adjacent to said store for cooperating with said command elements in response to the movement of said store, and means actuating said transducer for selectively moving said command elements into said operative position for causing one of said command elements on said operative position to couple said mechanical store with said motor shaft to be moved thereby and the other of said command elements positioned on said operative position to selectively connect said kinematic chains with said motor shaft for the operation of said hammer and said given functions in response to the movement of said mechanical store, and means for supporting said motor shaft, said hammer and said kinematic chains on said printing assembly.

17. A printing unit according to claim 16, wherein a single electromechanical transducer cooperates with said plurality of command elements, further comprising means for moving said mechanical store for causing said command elements to be serially cooperable with said transducer for the movement thereby, and means controlled by said store for holding said command elements on said operative position independently by said transducer during the operation of said hammer and said given functions.

18. A printing unit according to claim 17 wherein said moving means comprises a clutch commanded by one of said command elements for rotatably connecting said store with said motor shaft when said one command element is on said operative position.

19. A printing unit according to claim 16 wherein the mechanical store comprises a cylindrical drum rotatable about its own axis and wherein said command elements comprise a plurality of sliders slideable in slots of said drum as a result of the actuation of the said transducer, between two positions corresponding to said inoperative position and said operative position.

20. A printing unit according to claim 16, wherein the or each electromechanical transducer is an electromagnet.

21. A printing unit according to claim 16, comprising a plurality of detector assemblies of photoelectric type for control of the movement of some parts of the printing assembly and of the movement of the printing assembly with respect to the guide.

22. A printing unit according to claim 19, wherein a first type of sliders effects angular coupling between the drum and the motor in the operative position.

23. A printing unit according to claim 22, wherein said sliders comprise a second type of sliders, wherein the first and second types of movable sliders each have a radially corresponding extending coupling tooth slidably engaged in a first and second annular guide, respectively formed in the interior of a tubular body coaxial with respect to the drum and with respect to which the drum is mounted rotatably.

24. In a printing device of the type comprising a platen, a printing point, a wheel bearing a plurality of types, a motor shaft, means for releasably connecting for rotation said motor shaft with said wheel for the rotation of said wheel and an arrest member arresting said wheel and disconnecting said connecting means, the combination comprising:

a rotating member synchronous with said wheel and having thereon a number of teeth equal to a given fraction of the number of said plurality of types, wherein said teeth are spaced through a constant pitch, arresting pawls equal in number to the inverse of said given fraction movable between a rest position outside to rotating teeth to an operative position interfering with said teeth, wherein said arresting pawls on said operative position are progressively offset said given fraction with respect to said teeth, and actuating means for said arresting pawls including means synchronous with said rotating member controlling said pawls to be moved on said operative position only when a space between two of said teeth is passing in front of said pawls and means actuating one of said arresting pawls, for causing said rotating member to be angularly arrested on positions each aligning a type in front of said printing point.

25. A printing device according to claim 24, wherein the wheel bearing a plurality of type comprises a plurality of resiliently deformable radial fingers each bearing a corresponding character at a free end, and wherein said wheel is fixed to said rotating member.

26. In a printing device of the type comprising a platen, a wheel bearing a plurality of types, a rotatable motor shaft, means releasably connecting said motor shaft with said wheel for the rotation of said wheel and an arrest member arresting said wheel and disconnecting said connecting means, the combination comprising:

a pair of members rotating synchronously with said wheel and said motor shaft, respectively, and each having a surface, the surface of one of said members being faced to the surface of the other member, said surface defining thereon recesses uniformly distributed aligned with respect to a common circle, ball means housed in the recess of a first member of said rotating members, and spring means for normally urging said ball means against the recess of the second member of said pair for the coupling of said pair of members, said spring means causing said ball means to leave the recess of said first member and to slide on the surface of said second member for disconnecting said wheel from said motor.

27. A printing device of the type comprising a platen having a printing point, a wheel bearing a plurality of types, a motor shaft, means connecting said motor shaft with said wheel for the rotation thereof, a hammer for the printing of said types and an arrest member arresting said wheel and disconnecting said connecting means, the combination comprising:

cam means coupleable to said motor for operating said arrest member and said hammer, transducer means responsive to said electronic means to selectively couple said cam means to the shaft of said motor for operating said arrest member and said hammer when the selected type is positioned in front of said printing point, and a mechanical store coupled for rotation with said cam means, said mechanical store having at least a command element, settable on an operative position by said transducer means, wherein said hammer is normally loaded through a spring by said cam means and is arrested by a latch member against the action of said spring and wherein said command element causes said latch member to release said hammer for the printing of said types.

* * * * *